US009680234B2

(12) United States Patent
Love et al.

(10) Patent No.: US 9,680,234 B2
(45) Date of Patent: Jun. 13, 2017

(54) DUAL POLARIZATION GROUND-BASED PHASED ARRAY ANTENNA SYSTEM FOR AIRCRAFT COMMUNICATIONS AND ASSOCIATED METHODS

(71) Applicant: Harris Corporation, Melbourne, FL (US)

(72) Inventors: Leo Love, Melbourne, FL (US); Francis Eugene Parsche, Palm Bay, FL (US)

(73) Assignee: HARRIS CORPORATION, Melbourne, FL (US)

( * ) Notice: Subject to any disclaimer, the term of this patent is extended or adjusted under 35 U.S.C. 154(b) by 934 days.

(21) Appl. No.: 14/012,107

(22) Filed: Aug. 28, 2013

(65) Prior Publication Data

US 2015/0061936 A1 Mar. 5, 2015

(51) Int. Cl.
*H01Q 3/34* (2006.01)
*H01Q 25/00* (2006.01)
*H01Q 1/24* (2006.01)

(52) U.S. Cl.
CPC ..... *H01Q 25/001* (2013.01); *H01Q 1/246* (2013.01)

(58) Field of Classification Search
CPC ..... H01Q 3/30; H01Q 25/001
USPC ..... 342/361
See application file for complete search history.

(56) References Cited

U.S. PATENT DOCUMENTS 4,017,866 A 4/1977 Ray, Jr.
4,060,807 A 11/1977 Barton
4,072,942 A 2/1978 Alongi
4,203,111 A 5/1980 Buehring
5,003,315 A 3/1991 Skatvold, Jr.
5,028,930 A * 7/1991 Evans ..... H01Q 3/242 342/373
5,629,713 A * 5/1997 Mailandt ..... H01Q 1/246 343/792.5
5,812,091 A 9/1998 Robinson
6,201,801 B1 3/2001 Dent
6,667,714 B1 * 12/2003 Solondz ..... H01Q 1/246 342/368
7,026,989 B1 * 4/2006 Minkoff ..... H01Q 3/36 342/372
8,175,648 B2 5/2012 Johnson et al.
2003/0043071 A1 3/2003 Lilly et al.
2011/0241931 A1 10/2011 Krich et al.
2014/0327591 A1 * 11/2014 Kokkinos ..... H01Q 1/523 343/798

* cited by examiner

*Primary Examiner* — Helena Seraydaryan
(74) *Attorney, Agent, or Firm* — Allen, Dyer, Doppelt & Gilchrist, P.A. Attorneys at Law

(57) ABSTRACT

A ground-based antenna system includes a first phased array antenna to generate a first directional antenna beam at a first polarization, and a second phased array antenna to generate a second directional antenna beam at a second polarization. The first and second phased array antennas each include a lower antenna element row, an upper antenna element row, and medial antenna element rows therebetween. The ground-based antenna system further includes first and second antenna beam controllers cooperating with the first and second phased array antennas to generate a more steeply sloped phase taper associated with the lower antenna element row, a less steeply sloped phase taper associated with the medial antenna element rows, and a more steeply sloped phase taper associated with the upper antenna element row.

21 Claims, 6 Drawing Sheets

DUAL POLARIZATION GROUND-BASED PHASED ARRAY ANTENNA SYSTEM FOR AIRCRAFT COMMUNICATIONS AND ASSOCIATED METHODS

FIELD OF THE INVENTION

The present invention relates to the field of antennas, and more particularly, to a ground-based phased array antenna system and related methods.

BACKGROUND OF THE INVENTION

Ground-based antenna systems are commonly used for providing communications with moving aircraft. Transmit power and antenna gain at a ground-based antenna system are sufficient to overcome normal spreading attenuation losses as well as ambient background noise levels.

In addition to overcoming normal attenuation losses and ambient background noise levels, ground reflections also present a problem. Ground reflections may cause deep radiation pattern ripples and fades, as illustrated by the elevation plane radiation plot 20 in FIG. 1. Reflections from the ground of a transmitted communications signal cause constructive and destructive interference, which results in an elevation plane radiation pattern with peaks 22 and intervening deep ripples above the horizon. The valleys or nulls 24 within the ripples cause the antenna gain to be significantly reduced. Ideally, an elevation plane radiation pattern without ripples would be obtained if the ground reflections were not present. A particularly deep null or "ground tuck" appears in the radiation patterns at the horizon for both vertical and horizontal polarization.

One approach to filling the nulls within a reflected communications signal is to increase the effective isotropic radiated power (EIRP) of the ground-based antenna system. In most licensed frequency bands, the transmit power and/or antenna gain may be increased as needed. However, this is not permissible in some bands, such as the Industrial Scientific And Medical (ISM) band.

Another approach to account for ground reflections is to use an iterative clutter calibration method as disclosed in U.S. Published Patent Application No. 2011/0241931, which measures an average of a sidelobe power in a range-Doppler image for a plurality of ranges. A determined value of an objective function is responsive to an average of the sidelobe clutter power. A plurality of beamformer weights is modified and the step of determining the value of the objective function is repeated until a maximum value of the objective function is determined. Each beamformer weight determines a gain and phase of a respective antenna element in an antenna system.

However, when operating within the unlicensed industrial, scientific and medical (ISM) radio frequency (RF) band, the FCC places restrictions on transmit power and antenna gains of devices operating within this band. One of the ISM RF bands is within a frequency range of 2.4 GHz to 2.4835 GHz, and is reserved for industrial, scientific and medical purposes other than telecommunications. Example ISM applications include RF process heating, microwave ovens and medical diathermy machines.

In recent years, the fastest-growing use of this band has been for short-range, low power communications systems. For instance, low power communications devices operating within this frequency band include Wi-Fi devices, cordless phones, Bluetooth devices, near-field communication (NFC) devices and wireless computer networks. As a result of the proliferation of these short-range, low power communications systems, ground clutter within this ISM RF band has significantly increased.

Consequently, there is a need to reject this ground clutter as well as ground reflections when communicating within the ISM RF band using a ground-based antenna system and a moving aircraft. The difficulty is to overcome the ground clutter and ground reflections without increasing the EIRP of the ground-based antenna system beyond the limits imposed by the FCC part 15 rules.

SUMMARY OF THE INVENTION

In view of the foregoing background, it is therefore an object of the present invention to provide a ground-based antenna system that overcomes ground reflections and ground clutter when communicating with an airborne antenna.

This and other objects, features, and advantages in accordance with the present invention are provided by a ground-based antenna system to cooperate with an airborne antenna, and comprises first and second phased array antennas and first and second antenna beam controllers cooperating with the first and second phased array antennas.

The first phased array antenna may be configured to generate a first directional antenna beam at a first polarization and may comprise at least one lower antenna element row, at least one upper antenna element row, and a plurality of medial antenna element rows therebetween. The first antenna beam controller may cooperate with the first phased array antenna to generate a more steeply sloped phase taper associated with the at least one lower antenna element row, a less steeply sloped phase taper associated with the plurality of medial antenna element rows, and a more steeply sloped phase taper associated with the at least one upper antenna element row.

Similarly, the second phased array antenna may be configured to generate a second directional antenna beam at a second polarization and may comprise at least one lower antenna element row, at least one upper antenna element row, and a plurality of medial antenna element rows therebetween. The second antenna beam controller may cooperate with the second phased array antenna to generate a more steeply sloped phase taper associated with the at least one lower antenna element row, a less steeply sloped phase taper associated with the plurality of medial antenna element rows, and a more steeply sloped phase taper associated with the at least one upper antenna element row.

The less steeply sloped phase taper for the medial antenna elements advantageously steers or tilts the directional antenna beams above the horizon. The less steeply sloped phase taper may be independent from the more steeply sloped phase taper. The medial antenna elements thus control the tilt angle of the main beam, which is why the phase may be independently sloped (with respect to the more steeply sloped phase taper) as various wide ranging tilt angles may be desirable, while still maintaining the characteristic shape of the antenna pattern. The more steeply sloped phase taper for the at least one lower antenna element row and the at least one upper antenna element row advantageously suppress the lower sidelobe and fill in the nulls in the upper sidelobe which can be caused by the ground reflections and ground clutter.

The first antenna beam controller may cooperate with the first phased array antenna to generate an asymmetrical amplitude taper, and the second antenna beam controller may cooperate with the second phased array antenna to generate an asymmetrical amplitude taper. The asymmetrical amplitude taper advantageously helps to suppress the lower sidelobe and fills in the nulls in the upper sidelobe which can be caused by the ground reflections and ground clutter. A suppressed lower sidelobe advantageously provides close in, high look angle coverage with less radiation towards the ground.

The first and second phased array antennas may be configured to operate within a frequency range of 2.4 GHz to 2.4835 GHz. Each antenna element of the first and second phased arrays may be sized at a full wavelength of this operating frequency.

More particularly, the first and second phased array antennas may each comprises a respective ground plane adjacent respective antenna elements. Each antenna element of the first and second phased arrays may comprise a pair of spaced-apart dipoles, with the dipoles being parallel to one another. The pair of spaced-apart dipoles may comprise a pair of spaced-apart support posts each having a notch therein, and a pair of dipole arms carried by each support post and separated by the notch. A feed post may be between the pair of spaced-apart support posts and coupled to a corresponding one of the dipole arms of each dipole. The notch in each support post may be sized at a quarter wavelength of an operating frequency of the first and second phased array antennas so as to electrically separate the dipole arms carried by its support post.

The ground-based antenna system may further comprise a tower supporting the first and second phased array antennas. The first polarization may comprise horizontal polarization and the second polarization may comprise horizontal polarization.

Another aspect is directed to a method for operating a ground-based antenna system as described above to cooperate with an airborne antenna. The ground-based phased array antenna system may comprise a first phased array antenna configured to generate a first directional antenna beam at a first polarization, wherein the first ground-based phased array may comprise at least one lower antenna element row, at least one upper antenna element row, and a plurality of medial antenna element rows therebetween. The method may comprise operating a first antenna beam controller to cooperate with the first phased array antenna to generate a more steeply sloped phase taper associated with the at least one lower antenna element row, a less steeply sloped phase taper associated with the plurality of medial antenna element rows, and a more steeply sloped phase taper associated with the at least one upper antenna element row.

DETAILED DESCRIPTION OF THE PREFERRED EMBODIMENTS

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
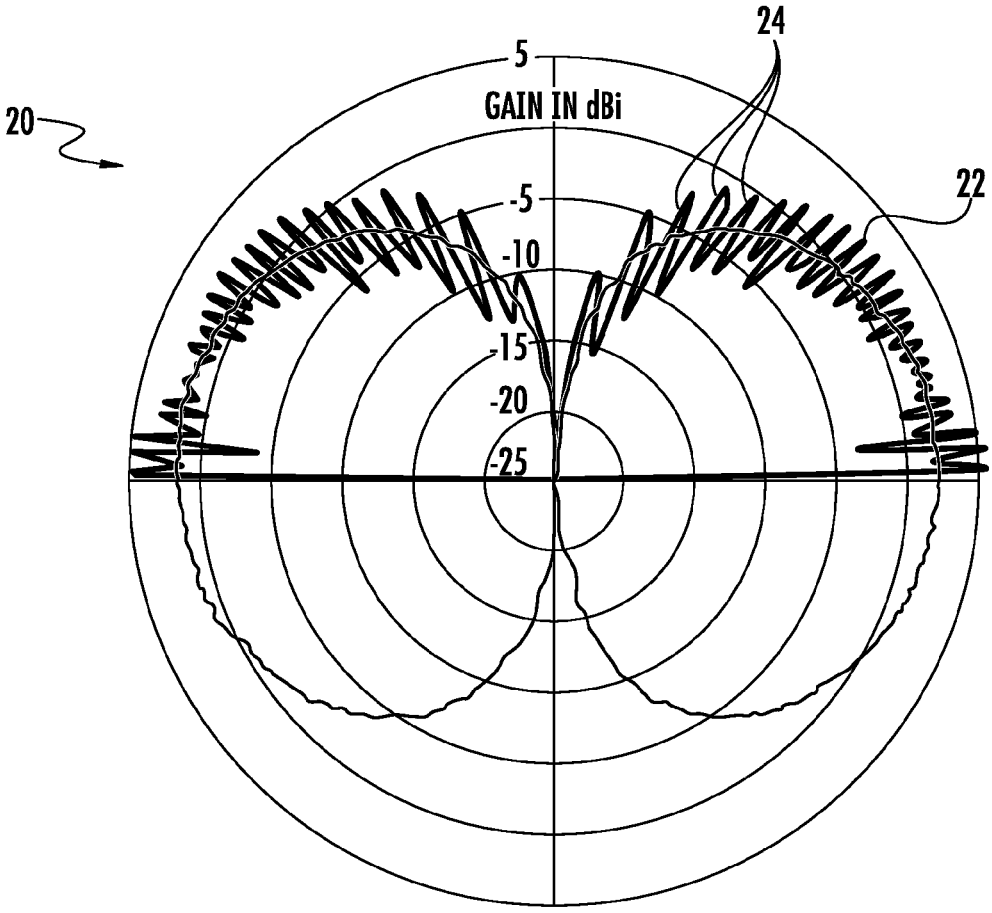
FIG. 1 (PRIOR ART)
FIG. 1 is an elevation plane radiation pattern plot for a ground-based antenna system in accordance with the prior art.
Figure 2:
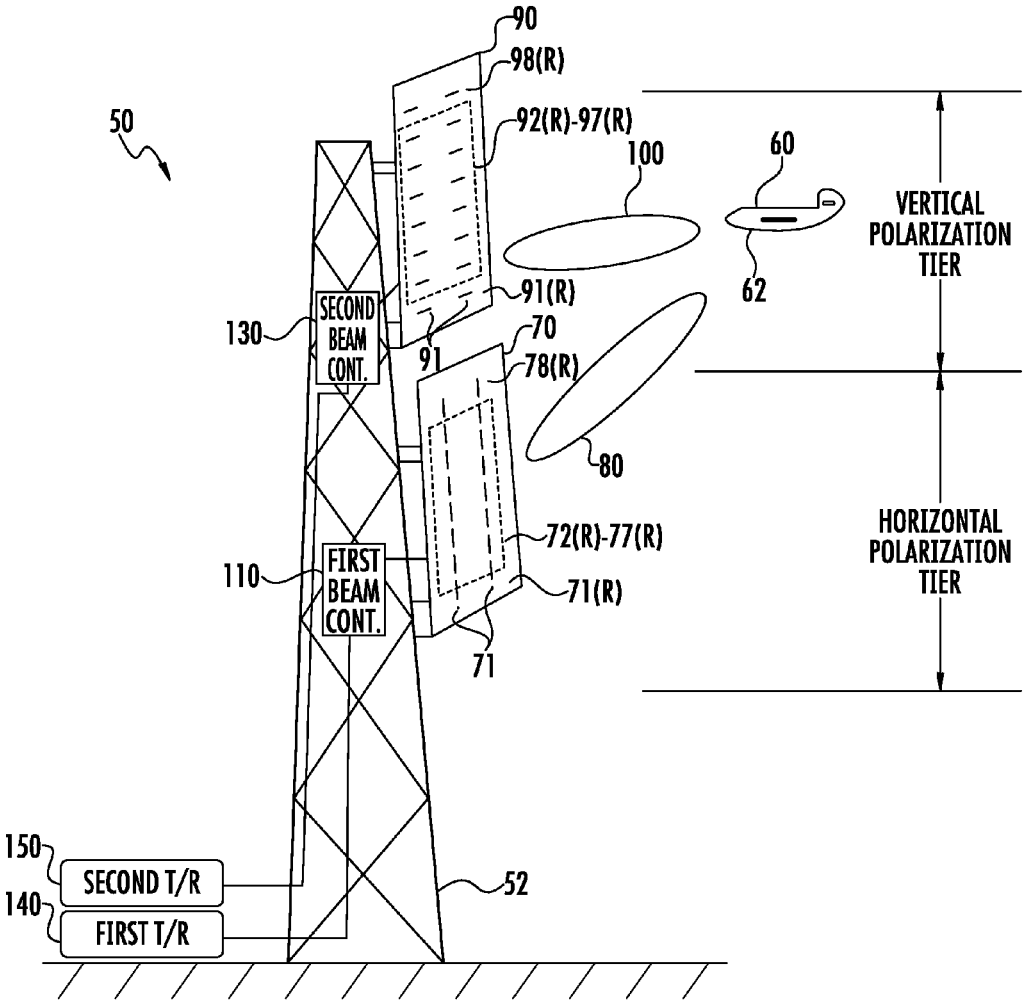
FIG. 2 is a block diagram of a ground-based antenna system generating directional antenna beams for aircraft communications in accordance with the present invention.
Figure 3:
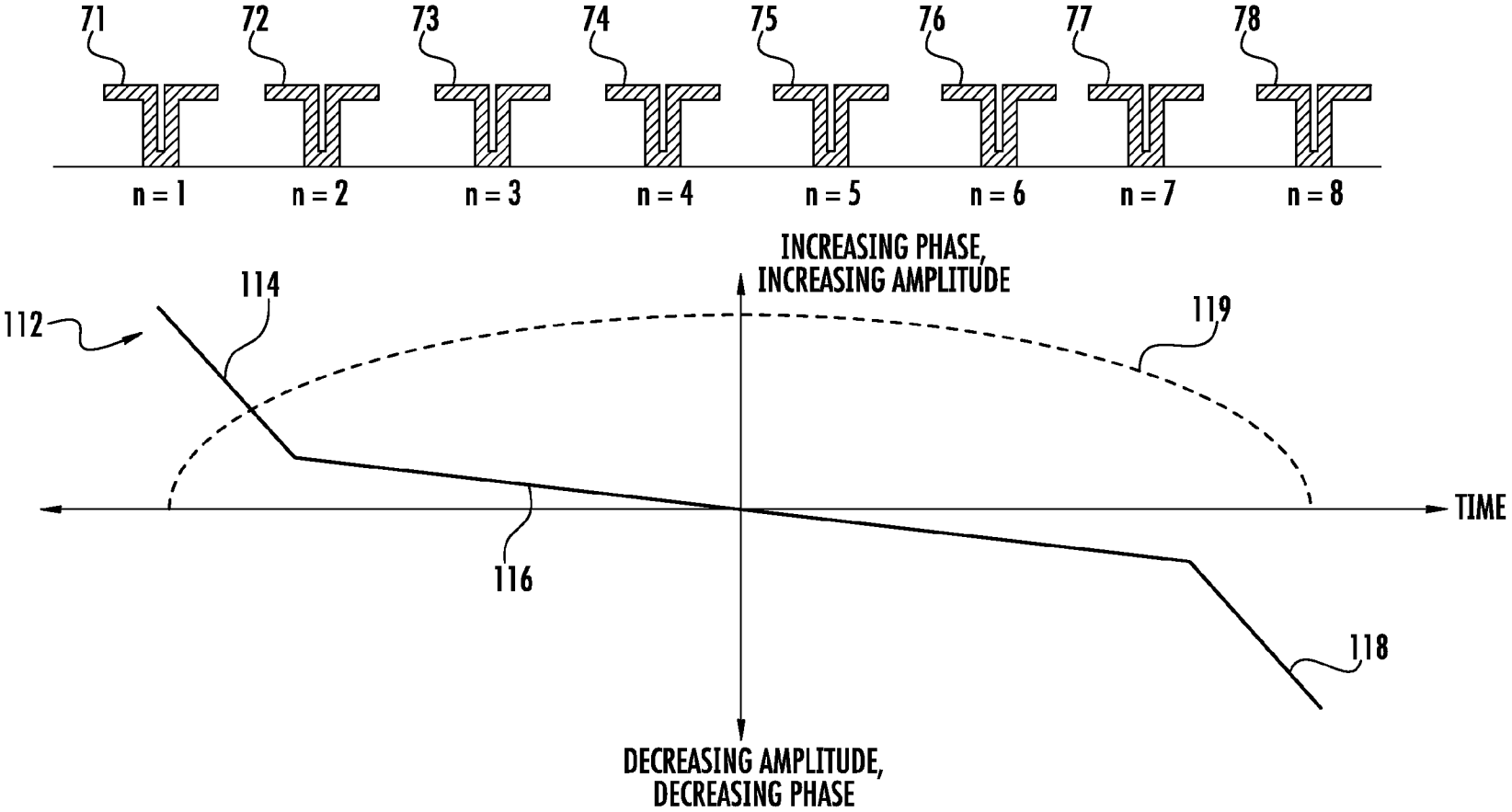
FIG. 3 is a plot of a first antenna beam control signal illustrating changes in phase and amplitude values with respect to the antenna elements for the first phased array antenna illustrated in FIG. 2.

Referring initially to FIGS. 2 and 3, a ground-based antenna system 50 for generating directional antenna beams 80, 100 for communications with an aircraft 60 will now be discussed. The aircraft 60 includes at least one cooperating antenna 62. The illustrated ground-based antenna system 50 includes first and second phased array antennas 70, 90 carried by a vertically extending tower 52, and respective first and second antenna beam controllers 110, 130 coupled to the first and second phased array antennas which are also carried by the tower. The first and second antenna beam controllers 110, 130 are illustrated as being separate from the first and second phased array antennas 70, 90. Alternatively, the first and second antenna beam controllers 110, 130 may be co-located with the first and second phased array antennas 70, 90 or they may even be separate from the tower 52.

A first transceiver 140 is coupled to the first antenna beam controller 110, and a second transceiver 150 is coupled to the second antenna beam controller 130. The first and second transceivers 140, 150 may be positioned away from the tower 52, as illustrated, or alternatively, they may be carried by the tower.

For purposes of simplifying the illustrated ground-based antenna system 50, only one set of first and second phased array antennas 70, 90 are shown. However, to provide 360 degree coverage, additional sets of first and second phased array antennas 70, 90 are used, as readily appreciated by those skilled in the art. Likewise, additional first and second antenna beam controllers 110, 130 and additional first and second transceivers 140, 150 would support the additional first and second phased array antennas 70, 90. The aircraft 60 would be tracked by switching between the multiple first and second phased array antennas 70, 90 as also readily appreciated by those skilled in the art.

The first and second phased array antennas 70, 90 and their respective first and second antenna beam controllers 110, 130 will now be discussed in greater detail. The first phased array antenna 70 is configured to generate the first directional antenna beam 80 at a first polarization based on a first antenna beam control signal from the first antenna beam controller 110. Similarly, the second phased array antenna 90 is configured to generate the second directional antenna beam 100 at a second polarization based on a second antenna beam control signal from the second antenna beam controller 130.

The first phased array antenna 70 may be mounted such that the first polarization corresponds to horizontal polarization, and the second phased array antenna 90 may be mounted such that the second polarization corresponds to vertical polarization. As background, polarization refers to the orientation of radio wave electric fields. For horizontal polarization the E fields are parallel to the earth's surface, and for vertical polarization the E fields are normal to the earth's surface. Of course, other mounting arrangements of the first and second phased array antennas 70, 90 will change the polarization, but in general they will be orthogonal to one another.

The first phased array antenna 70 includes at least one lower antenna element row 71(R), at least one upper antenna element row 78(R), and a plurality of medial antenna element rows 72(R)-77(R) therebetween. For illustration purposes, the first phased array antenna 70 includes a 2 by 8 array of antenna elements. The at least one lower antenna element row 71(R) is illustratively a single row with two antenna elements 71. The plurality of medial antenna element rows 72(R)-77(R) is illustratively six rows with two antenna elements 72-77 in each row. The at least one upper antenna element row 78(R) also is illustratively a single row with two antenna elements 78.

The first phased array antenna 70 is not limited to 16 antenna elements, and may be more or less depending on the intended application. Also, the first phased array antenna 70 is not limited to two columns, and may be as few as a single column and more than two columns depending on the intended application. Each antennas element row may thus include one or more antenna elements.

The lower, medial and upper nomenclatures referring to the antenna element rows is based on position, as well as the order in which each particular antenna element receives the first antenna beam control signal 112, as best illustrated in FIG. 3. The first antenna beam control signal 112 has 3 phase taper portions. A more steeply sloped phase taper 114 is for the lower antenna elements 71, the less steeply sloped phase tapper 116 is for the medial antenna elements 72-77, and the more steeply sloped phase taper 118 is for the upper antenna elements 78. One column of the antenna elements 71-78 is schematically positioned above the first antenna beam control signal 112 to illustrate which phase taper portions 114, 116, 118 they are to receive. The first antenna beam controller 110 also cooperates with the first phased array antenna 70 to generate a symmetrical amplitude taper, as indicated by the dashed amplitude line 119 in FIG. 3.

Figure 4:
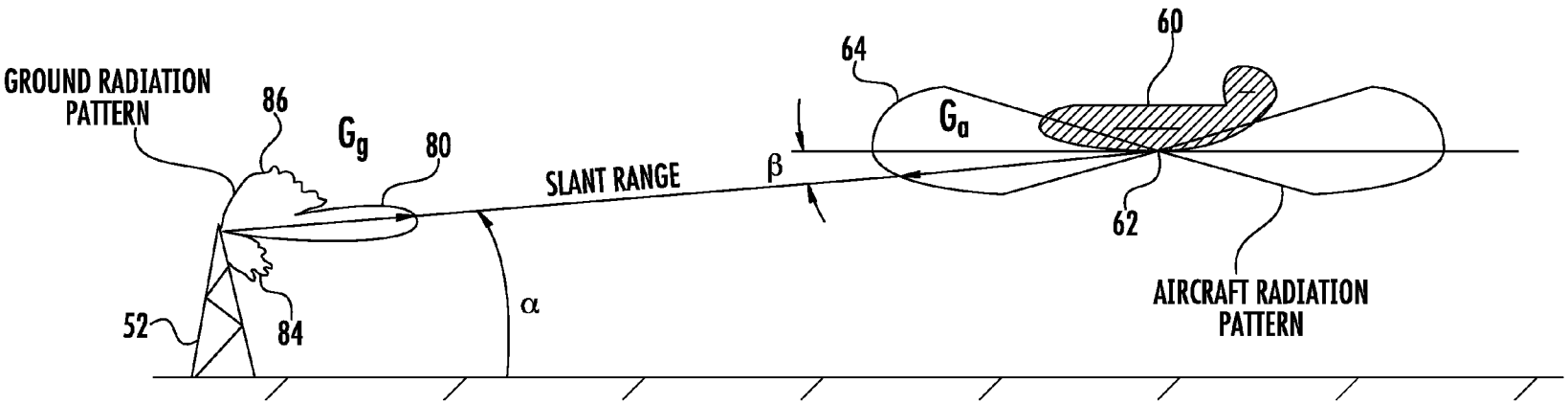
FIG. 4 is a diagram illustrating an elevation radiation pattern from the first phased array antenna directed towards an airborne antenna on the aircraft as illustrated in FIG. 2.

The less steeply sloped phase taper portion 116 for the medial antenna elements 72-77 advantageously steers or tilts the directional antenna beam 80 above the ground (i.e., horizon) as illustrated in FIG. 4. The less steeply sloped phase taper may be independent from the more steeply sloped phase taper. The medial antenna elements 72-77 thus control the tilt angle of the main directional antenna beam 80, which is why the phase may be independently sloped (with respect to the more steeply sloped phase taper) as various wide ranging tilt angles may be desirable, while still maintaining the characteristic shape of the antenna pattern. The more steeply sloped phase taper portions 114, 118 for the lower and upper antenna elements 71, 78 in combination with the asymmetrical amplitude taper advantageously suppress the lower sidelobe 84 and fill in the nulls in the upper sidelobe 86 which can be caused by the ground reflections and ground clutter as also illustrated in FIG. 4. This may be accomplished without increasing the gain of the phased array antenna 70 or increasing the transmit power of the first transceiver 140.

A frequency of operation of the first and second phased array antennas 70, 90 may be within the ISM RF band of 2.4 GHz to 2.4835 GHz, for example, where ground clutter and ground reflections are a problem due. This is due to the proliferation of short-range, low power communications systems operating within the RF band, such as Wi-Fi devices, cordless phones, Bluetooth devices, near-field communication (NFC) devices, and wireless computer networks.

As discussed above in the background, the difficulty in overcoming the ground clutter and ground reflections is to do so without increasing the EIRP of the ground-based antenna system 50 beyond the limits imposed by the FCC part 15 rules. By tapering the phase of the phase control signal, as well as asymmetrically varying the amplitude of the phase control signal, this advantageously tilts the main directional antenna beam 80 above the ground while suppressing the lower sidelobe 84 and filling in the nulls in the upper sidelobe 86 potentially caused by the ground reflections and ground clutter as also illustrated in FIG. 4. This is accomplished without increasing the gain of the phased array antenna 70 or increasing the transmit power of the first transceiver 140.

Nonetheless, the frequency of operation of the first and second phased array antennas 70, 90 is not limited to the ISM RF band of 2.4 GHz to 2.4835 GHz. The first and second phased array antennas 70, 90 may be scaled to operate at frequencies above or below this band, as readily appreciated by those skilled in the art.

A slope of the phase taper portion 116 for the medial antenna elements 72-77 may be within a range of about 5 to 15 degrees, whereas the more steeply sloped phase taper portions 114, 118 for the lower and upper antenna elements 71, 78 may be within a range of about 25 to 75 degrees. Mathematically, if the slope of the phase taper portion 116 is X for small acute main beam tilt angles above the horizon, then the more steeply sloped phase taper portions 114, 118 are within a range of 5× to 15×.

The more steeply sloped phase taper portion 118 for the upper antenna element 78 may have the same slope as the more steeply sloped phase taper portion 114 for the lower antenna element 71. Alternatively, the two slopes may be different from one another.

The first antenna beam controller 110 also cooperates with the first phased array antenna 70 to generate an asymmetrical amplitude taper, as indicated by the dashed amplitude line 119 in. FIG. 3. The dashed amplitude line 119 thus represents the tapering amplitude each antenna element 71-78 is to receive from their portion of the first antenna beam control signal 112.

The amplitude taper of the first antenna beam control signal 112 is gradually raised or increased for the lower antenna element 71 and for half of the medial antenna elements 72-74. For the other half of the medial antenna elements 75-77 and upper antenna element 78, the amplitude taper of the first antenna beam control signal 112 is gradually lowered or decreased. The amplitude taper advantageously helps to suppress the lower sidelobe 84 and to fill in the nulls in the upper sidelobe 86 potentially caused by the ground reflections and ground clutter. Suppressed lower sidelobes advantageously provide close in, high look angle coverage with less radiation towards the ground.

The second phased array antenna 90 also includes at least one lower antenna element row, at least one upper antenna element row, and a plurality of medial antenna element rows therebetween. The second phased array antenna 90 includes at least one lower antenna element row 91(R), at least one upper antenna element row 98(R), and a plurality of medial antenna element rows 92(R)-97(R) therebetween. For illustration purposes, the second phased array antenna 90 includes a 2 by 8 array of antenna elements. The at least one lower antenna element row 91(R) is illustratively a single row with two antenna elements 91. The plurality of medial antenna element rows 92(R)-97(R) is illustratively six rows with two antenna elements 92-97 in each row. The at least one upper antenna element row 98(R) also is illustratively a single row with two antenna elements 98.

Since operation and performance of the second phased array antenna 90 and the second antenna beam controller 130 are similar to the operation and performance of the first phased array antenna 70 and the first antenna beam controller 110, the second phased array antenna and the second antenna beam controller will not be discussed with the same detail.

Each phased array antenna 70, 90 thus includes an array of antenna elements 71-78, 91-98 to generate the directional antenna beams 80, 100. Controlling the gain and phase of the individual antenna elements shapes and steers the directional antenna beams in a desired direction, as readily appreciated by those skilled in the art.

The first and second phased array antennas 70, 90 may be positioned one above the other on the tower 52, as illustrated in FIG. 2. Even though the first phased array antenna 70 is positioned below the second phased array antenna 90, other embodiments include the first phased array antenna positioned above the second phased array antenna. Yet another embodiment is to have the antenna elements co-positioned together while still providing an orthogonal polarization.

Referring back to FIG. 4, the ground-based antenna system 50 may be optimized for maintaining a constant signal strength with changing slant range and take off angle ranges when communicating with a moving aircraft 60. Less signal strength is needed when the aircraft 60 is over the tower 52, whereas more signal strength is needed with the aircraft is further away from the tower. For instance, transmission loss increases with $1/r^2$ so every doubling of slant range distance causes a four fold (6 decibel) reduction in signal strength due to wave expansion. A cosecant$^2$ function may be used to optimize the ground and aircraft elevation cut radiation patterns to provide constant signal strength with aircraft position. Such a cosecant (csc) function, representing the gain $G_g$ between the first phased array antenna 70 and the gain $G_a$ of the aircraft antenna 62, may be expressed as follows:

$$G_a+G_g=10\log(csc^{2\gamma})\text{ in dBi}$$

Where $\gamma=\alpha=\beta$ in degrees $G_g$=Gain of ground antenna at take off angle $\alpha$ $G_a$=Gain of aircraft antenna at take off angle $\beta$ Coordination between the ground-based antenna system 50 and the aircraft 60 thus allows the gain of the first directional antenna beam 80 and the gain of the aircraft or airborne antenna 64 to be adjusted so that a constant or near constant or desirable signal strength is maintained. The slant range decreases when the aircraft is overhead and is much less than the slant range distance to the horizon. For example, if the aircraft 60 is at an altitude of 55,000 ft., the straight down range is 10.4 miles but the range to the horizon is 287 miles; this corresponds to a spreading loss of 106.4 dB versus 135.2 dB, respectively, which is a difference of 28.8 dB.

Figure 5:
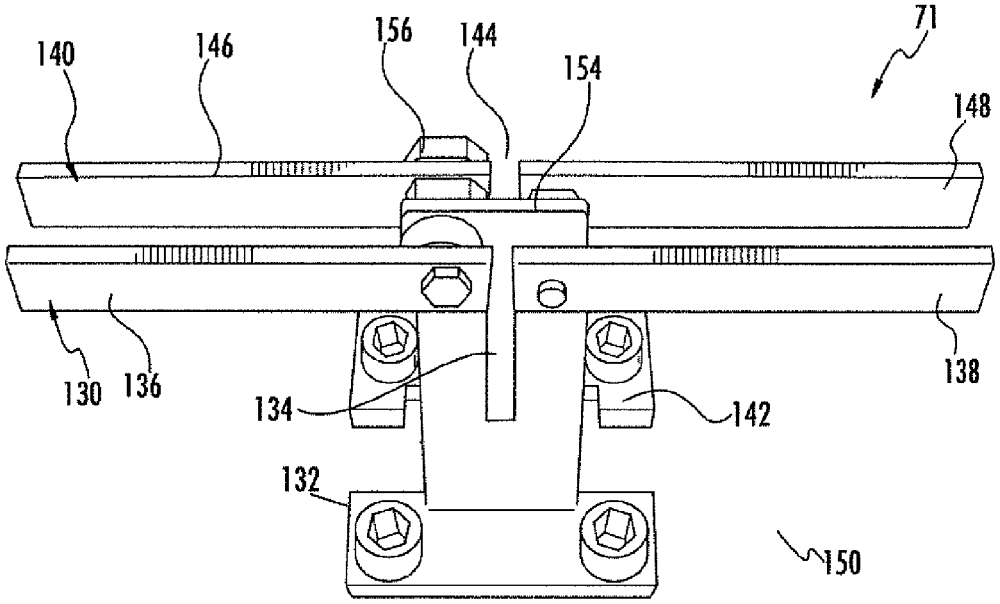
FIG. 5 is a side perspective view an antenna element for the phased array antennas illustrated in FIG. 2.
Figure 6:
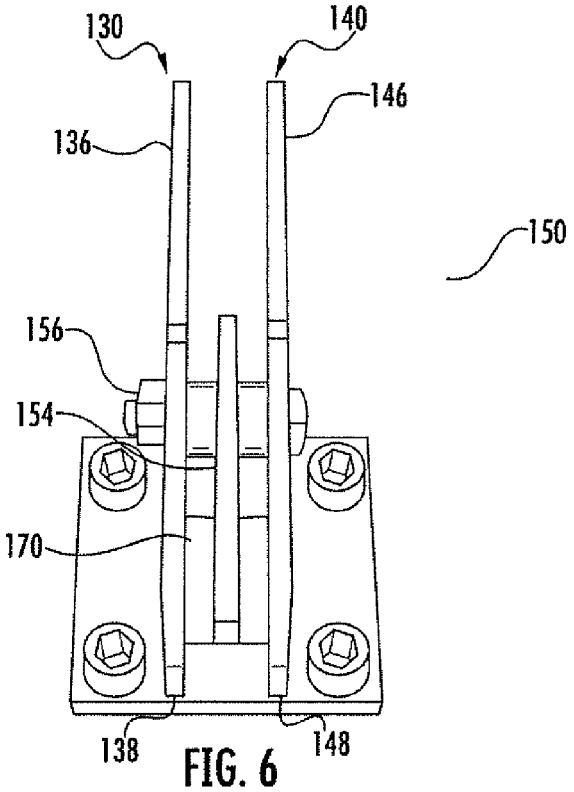
FIG. 6 is an end/upper perspective view of the antenna element illustrated in FIG. 5.

Referring now to FIGS. 5 and 6, the antenna elements 71-78, 91-98 of the first and second phased array antennas 70, 90 will be discussed in greater detail. For discussion purposes, reference will be made to just one of the antenna elements in one of the rows since the other antenna elements have a similar construction.

Antenna element 71, for instance, is a broadband dipole radiating element comprising a pair of spaced-apart dipoles 130, 140. The dipoles 130, 140 are parallel to one another. Each dipole 130, 140 may be sized at a full wavelength of an operating frequency of the first phased array antenna 70. This helps to place nulls on the horizon. The first phased array antenna 70 includes a ground plane 150 adjacent the antenna element 71. The current distribution in the dipole element may be adjusted to produce horizon nulling in the radiation pattern. This may be accomplished by adjustment of the dipole length, such as a 1 wavelength dipole, a ½ wavelength spacing between the dipole and plane reflector, a plurality of dipole feedpoints or otherwise. A full wavelength dipole produces a 4 petal rose E plane radiation pattern, with a deep null exactly broadside to the dipole axis, and with the deep null being positioned on the horizon.

The pair of spaced-apart dipoles 130, 140 includes a pair of spaced-apart support posts 132, 142 each having a notch 134, 144 therein, and a pair of dipole arms 136, 138 and 146, 148 carried by each support post and separated by their respective notches. The notch 134, 144 in each support post may be sized at a quarter wavelength of an operating frequency of the first phased array antenna 70 so as to keep the support posts 132, 142 from radiating, and to provide a DC ground.

In addition, a feed post 154 is between the pair of pair of spaced-apart support posts 132, 142 and is coupled to a corresponding one of the dipole arms of each dipole. In the illustrated embodiment, the feed post 154 is connected to dipole arms 136, 146. The cable feeding the antenna element 71 is a stripline, where the inner conductor connects to the feed post 154 which is inserted through an opening 170 in the ground plane 150 between the pair of spaced-apart support posts 132, 142.

The tap locations 156 for connection of the feed post 154 may be vertically varied to adjust a driving resistance of the antenna element 71. The driving resistance is lowered if the tap locations 156 are placed closer to the ground plane 150, and is increased if the tap locations are placed further away from the ground plane.

The outer conductor of the stripline may connect to the other dipole arms 138, 148 via the isolated half of the support posts 132, 142. As noted above, the notches 134, 144 are sized so as to keep the support posts 132, 142 from radiating, and to provide a DC ground, which in turn, isolates dipole arms 136, 146 from dipole arms 138, 148. As an alternative to using a stripline feed, a coaxial cable may be used, where the inner conductor still connects to the tap locations 156 on dipole arms 136, 146 but the outer conductor connects to dipole arms 138, 148.

Even though the antenna elements are illustrated as dipole elements, other types of antenna elements may be used with the first and second phased array antennas 70, 90. For example, patch antenna elements may be used.

Figure 7:
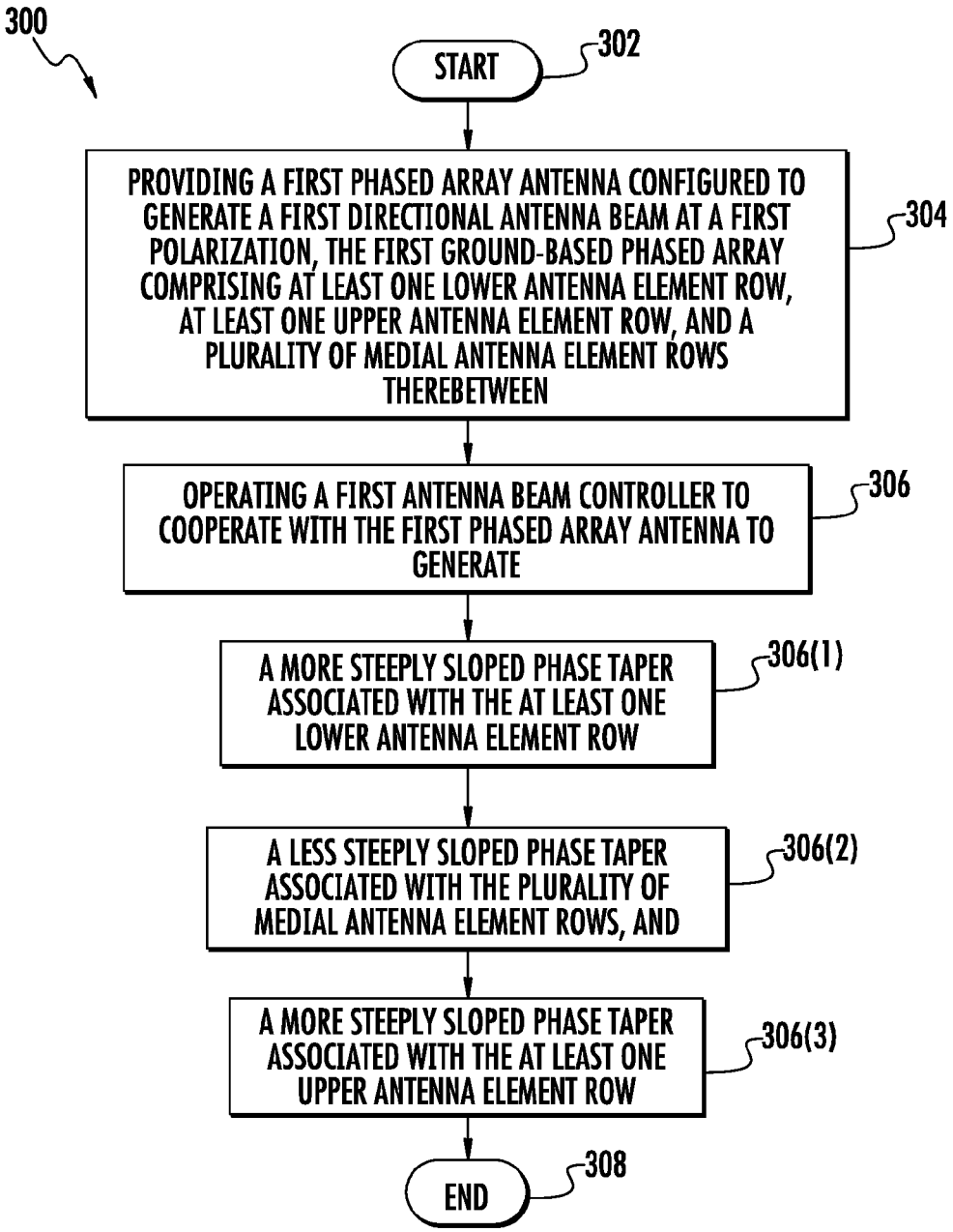
FIG. 7 is a flowchart illustrating a method for operating the ground-based antenna system to cooperate with the airborne antenna illustrated in FIG. 2.

Referring now to the flowchart 300 in FIG. 7, another aspect is directed to a method for operating a ground-based antenna system 50 to cooperate with an airborne antenna 62 as described above. From the start (Block 302), the method comprises providing a first phased array antenna 70 at Block 304 to generate a first directional antenna beam 80 at a first polarization. The first phased array antenna 70 includes at least one lower antenna element row 71, at least one upper antenna element row 78, and a plurality of medial antenna element rows 72-77 therebetween. The method further comprises at Block 306 operating a first antenna beam controller 110 to cooperate with the first phased array antenna 70. The operations include generating a more steeply sloped phase taper 114 associated with the at least one lower antenna element row 71 at Block 306(1), a typically less steep, but independently sloped phase taper 116 associated with the plurality of medial antenna element rows 72-77 at Block 306(2), and a more steeply sloped phase taper 118 associated with the at least one upper antenna element row 78 at Block 306(3). The method ends at Block 308.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A ground-based antenna system to cooperate with an airborne antenna, comprising:

a first phased array antenna configured to generate a first directional antenna beam at a first polarization and comprising at least one lower antenna element row, at least one upper antenna element row, and a plurality of medial antenna element rows therebetween, with each row comprising a plurality of antenna elements;

a first antenna beam controller cooperating with said first phased array antenna and configured to generate a first sloped phase taper associated with said at least one lower antenna element row, a second sloped phase taper associated with said plurality of medial antenna element rows, and a third sloped phase taper associated with said at least one upper antenna element row, and with the first and third sloped phase tapers being sloped more than the second sloped phase taper;

a second phased array antenna configured to generate a second directional antenna beam at a second polarization and comprising at least one lower antenna element row, at least one upper antenna element row, and a plurality of medial antenna element rows therebetween, with each row comprising a plurality of antenna elements; and a second antenna beam controller cooperating with said second phased array antenna and configured to generate a fourth sloped phase taper associated with said at least one lower antenna element row, a fifth sloped phase taper associated with said plurality of medial antenna element rows, a sixth sloped phase taper associated with said at least one upper antenna element row, and with the fourth and sixth sloped phase tapers being sloped more than the fifth sloped phase taper.

2. The ground-based antenna system according to claim 1 wherein said first antenna beam controller cooperates with said first phased array antenna to generate a symmetrical amplitude taper; and wherein said second antenna beam controller cooperates with said second phased array antenna to generate a symmetrical amplitude taper.

3. The ground-based antenna system according to claim 1 wherein each antenna element of said first and second phased arrays is sized at a full wavelength of an operating frequency.

4. The ground-based antenna system according to claim 1 wherein said first and second phased array antennas each comprises a respective ground plane adjacent respective antenna elements.

5. The ground-based antenna system according to claim 1 wherein each antenna element of said first and second phased arrays comprises a pair of spaced-apart dipoles, with said dipoles being parallel to one another.

6. The ground-based antenna system according to claim 5 wherein said pair of spaced-apart dipoles comprises a pair of spaced-apart support posts each having a notch therein, and a pair of dipole arms carried by each support post and separated by the notch; and further comprising a feed post between said pair of spaced-apart support posts and coupled to a corresponding one of said dipole arms of each dipole.

7. The ground-based antenna system according to claim 6 wherein the notch in each support post is sized at a quarter wavelength of an operating frequency of said first and second phased array antennas.

8. The ground-based antenna system according to claim 1 wherein said first and second phased array antennas are configured to operate within a frequency range of 2.4 GHz to 2.4835 GHz.

9. The ground-based antenna system according to claim 1 further comprising a tower supporting said first and second phased array antennas.

10. The ground-based antenna system according to claim 1 wherein the first polarization comprises horizontal polarization and the second polarization comprises vertical polarization.

11. A ground-based antenna system to cooperate with an airborne antenna, comprising:

a phased array antenna configured to generate a directional antenna beam at a first polarization and comprising at least one lower antenna element row, at least one upper antenna element row, and a plurality of medial antenna element rows therebetween, with each row comprising a plurality of antenna elements; and an antenna beam controller cooperating with said first phased array antenna and configured to generate a first sloped phase taper associated with said at least one lower antenna element row, a second sloped phase taper associated with said plurality of medial antenna element rows, a third sloped phase taper associated with said at least one upper antenna element row, and with the first and third sloped phase tapers being sloped more than the second sloped phase taper.

12. The ground-based antenna system according to claim 11 wherein said antenna beam controller cooperates with said phased array antenna to generate a symmetrical amplitude taper.

13. The ground-based antenna system according to claim 11 wherein each antenna element of said first phased array is sized at a full wavelength of an operating frequency.

14. The ground-based antenna system according to claim 11 wherein said first phased array antenna comprises a ground plane adjacent the antenna elements.

15. The ground-based antenna system according to claim 11 wherein each antenna element of said first phased array comprises a pair of spaced-apart dipoles, with said dipoles being parallel to one another.

16. The ground-based antenna system according to claim 15 wherein said pair of spaced-apart dipoles comprises a pair of spaced-apart support posts each having a notch therein, and a pair of dipole arms carried by each support post and separated by the notch; and further comprising a feed post between said pair of spaced-apart support posts and coupled to a corresponding one of said dipole arms of each dipole.

17. A method for operating a ground-based antenna system to cooperate with an airborne antenna, the ground-based antenna system comprising a first phased array antenna configured to generate a first directional antenna beam at a first polarization, the first phased array antenna comprising at least one lower antenna element row, at least one upper antenna element row, and a plurality of medial antenna element rows therebetween, with each row comprising a plurality of antenna elements, the method comprising:

operating a first antenna beam controller to cooperate with the first phased array antenna to generate a first sloped phase taper associated with the at least one lower antenna element row, a second sloped phase taper associated with the plurality of medial antenna element rows, a third sloped phase taper associated with the at least one upper antenna element row, and with the first and third sloped phase tapers being sloped more than the second sloped phase taper.

18. The method according to claim 17 wherein the ground-based phased array system further comprises a second phased-array antenna configured to generate a second directional beam at a second polarization, the second ground phased array antenna comprising at least one lower antenna element row, at least one upper antenna element row, and a plurality of medial antenna element rows therebetween, with each row comprising a plurality of antenna elements; and wherein the method further comprises:

operating a second antenna beam controller to cooperate with the second phased array antenna to generate a fourth sloped phase taper associated with the at least one lower antenna element row, a fifth sloped phase taper associated with the plurality of medial antenna element rows, a sixth sloped phase taper associated with the at least one upper antenna element row, and with the fourth and sixth sloped phase tapers being sloped more than the fifth sloped phase taper.

19. The method according to claim 18 further comprising:

operating the first antenna beam controller to cooperate with the first phased array antenna to generate a symmetrical amplitude taper; and operating the second antenna beam controller to cooperate with the second phased array antenna to generate a symmetrical amplitude taper.

20. The method according to claim 18 wherein the first polarization comprises horizontal polarization and the second polarization comprises vertical polarization.

21. The method according to claim 18 wherein the first and second phased array antennas are configured to operate within a frequency range of 2.4 GHz to 2.4835 GHz.

* * * * *